US006729784B2

(12) United States Patent
Gioffre

(10) Patent No.: US 6,729,784 B2
(45) Date of Patent: May 4, 2004

(54) SECURING SHOELACES AND OTHER TIES

(75) Inventor: Anthony J. Gioffre, Ridgefield, CT (US)

(73) Assignee: Ideas To Sales LLC, Ridgefield, CT (US)

( * ) Notice: Subject to any disclaimer, the term of this patent is extended or adjusted under 35 U.S.C. 154(b) by 137 days.

(21) Appl. No.: 10/055,067

(22) Filed: Jan. 23, 2002

(65) Prior Publication Data

US 2002/0100150 A1 Aug. 1, 2002

Related U.S. Application Data

(60) Provisional application No. 60/264,791, filed on Jan. 29, 2001.

(51) Int. Cl.[7] ..... A46B 11/00

(52) U.S. Cl. ..... 401/10; 401/9; 24/712.2

(58) Field of Search ..... 401/10, 1, 2, 9; 24/712.2, 713, 712

(56) References Cited

U.S. PATENT DOCUMENTS 4,105,611 A * 8/1978 Orth, Jr. ..... 524/143
4,345,349 A * 8/1982 Flanagan ..... 412/5
4,983,180 A * 1/1991 Kawai et al. ..... 606/230
5,272,796 A * 12/1993 Nichols ..... 24/712
6,148,489 A * 11/2000 Dickie et al. ..... 24/712.6

* cited by examiner

*Primary Examiner*—David J. Walczak

(57) ABSTRACT

A method for inhibiting the loosening of knotted ties, e.g., shoelaces, by applying to the ties a waxy composition comprising a waxy ingredient effective to inhibit the ties from becoming untied. Applicators suitable for applying compositions to ties are also disclosed.

5 Claims, 2 Drawing Sheets

SECURING SHOELACES AND OTHER TIES

This application claims the benefit of U.S. Provisional Application No. 60/264,791 filed Jan. 29, 2001.

FIELD OF THE INVENTION

The present invention relates to inhibiting knotted ties, e.g., shoelaces, from loosening and more particularly to waxy compositions and their use in methods for inhibiting knotted ties from loosening, and applicator devices for applying the waxy compositions to the ties.

BACKGROUND OF THE INVENTION

Untying of shoelaces is a common problem and practically everyone in his or her life experiences occurrences of shoelaces loosening or becoming untied which can be annoying and even dangerous. The problem is particularly acute with children and athletes. For example, many young toddlers cannot tie their shoes once they become untied. Often, the toddlers will trip over the untied laces and become injured. Athletes, especially runners, commonly have to stop running and tie their shoelaces during an athletic event. Apart from the risk of physical injury caused by tripping over an untied shoelace, time lost in an athletic event, or even during a recreational jog can be frustrating. Furthermore, when one stops suddenly after rigorous physical exertion without cooling down, there can be an increased risk of cardiac arrest. The problem of loosening knots is also encountered with other ties, such as, for example, clothing ties, e.g., sweatshirt hood cords.

A number of factors can cause untying of a bow-knot in a tie, including cyclic fatigue, stress and strain, compression and expansion of the portion forming the bow-knot and/or a length of the tie which passes through the eyelets of the shoe, in the case of a shoelace, the type of bow-knot, type of fiber used in the tie yarn, and the method of forming of the tie.

Proposed solutions in the shoelace art include, for example, the formation of a number of protuberances longitudinally spaced, either along the entire length of the lace, or a segment on each end of the lace intended for use in forming the bow-knot. These protuberances are to help retain the bow-knot, and segments of the laces passing through the eyelets of the shoe, in position and to resist untying of the laces.

In some methods known in the art, protuberances are formed on shoelaces after the laces have been manufactured by weaving, including tubular weaving, braiding, or knitting. The prior art has also suggested that various types of protuberances be incorporated into the shoelace.

U.S. Pat. No. 2,639,481 describes a shoe lace having protuberances formed by sewing a length of special thread repeatedly through the lace after the original process of producing the laces has been completed. U.S. Pat. No. 2,477,151 discloses a shoelace having a strand of round section woven back and forth at spaced intervals through the lace along its length to form protuberances after the original lace has been produced.

In U.S. Pat. No. 2,306,515 a different approach has been taken to form protuberances by using metal staples of different shapes along a segment at each end of the lace. The metal staples are inserted in the lace after the lace has been produced. U.S. Pat. No. 5,272,796 discloses the manufacture of a shoelace by weaving or braiding strands having a conventional coefficient of friction with at least one strand having a higher coefficient of friction. The higher friction strand is made in a separate process by impregnating a conventional strand with friction enhancing substances. The impregnated strand is then introduced into the lace at the time of manufacture by a weaving or braiding process.

U.S. Pat. Nos. 4,247,967 and 5,074,031 describe the production of a slip resistant shoelace using Velcro. In U.S. Pat. No. 4,247,967, a slip resistant binding is formed by attaching male and female Velcro strips or other binding material along opposite ends of a shoelace. In U.S. Pat. No. 5,074,031, the lace is provided only with hook-type Velcro. The patent relies on the natural loop structure of woven or braided fabric to provide the loops with which the hook-type Velcro co-operates.

U.S. Pat. No. 3,110,945 refers to production of a slip resistant lace by providing, in combination with a standard tipped tubular weave shoelace, a plurality of spaced protuberances in the form of knots tied at reselected intervals along the length of the lace. U.S. Pat. No. 3,518,730 employs an approach wherein protuberances are not formed by introducing any special strand or other material. Instead, the shoelace has a thin central core, formed from one to ten parallel strands that are surrounded by oppositely wound strands having less linear extensibility then the core strands. The result is a roughened surface on the lace which resists untying.

In addition to improvements in shoelace design as described above, other solutions to the problem of inhibiting the loosening of shoelaces have been directed to the use of various clips and other mechanical means to secure the knot after the shoelace is tied. Note, for example, U.S. Pat. No. 4,291,439 issued Sep. 29, 1981, U.S. Pat. No. 4,553,293 issued Nov. 19, 1985, U.S. Pat. No. 4,571,854 issued Feb. 25, 1985, U.S. Pat. No. 4,780,936 issued Nov. 1, 1988, U.S. Pat. No. 4,879,787 issued Nov. 14, 1989, U.S. Pat. No. 4,999,888 issued Mar. 19, 1991, U.S. Pat. No. 5,042,119 issued Aug. 27, 1991, U.S. Pat. No. 5,170,573 issued Dec. 15, 1992 and U.S. Pat. No. 5,946,779 issued Sep. 7, 1999.

The attempts to solve the problem of loosening ties described in the prior art are expensive and have not proven to be practical or effective when applied to conventional commercial ties such as the shoelaces in sneakers and other athletic shoes. Accordingly, there is still a critical need for a practical and inexpensive solution to the problem of knotted ties loosening and becoming untied.

SUMMARY OF THE INVENTION

The present invention relates to solid waxy compositions and a method of inhibiting the loosening of a knotted tie which includes the step of applying such solid waxy composition to at least that portion of the tie involved in creating a knot.

The present invention also relates to applicator devices for applying the solid waxy composition to a tie. In one embodiment of the invention, an applicator device having an elongated body which is filled with the solid waxy composition, has an opening through opposite side walls of the applicator's elongated body to allow passage of the tie through the applicator so that the solid waxy composition is applied to the surface of the tie.

By virtue of the present invention, it is no longer necessary to use replacement ties having special designs or to use clips or other mechanical devices which must remain affixed to the tie during use.

DETAILED DESCRIPTION

Figure 1:
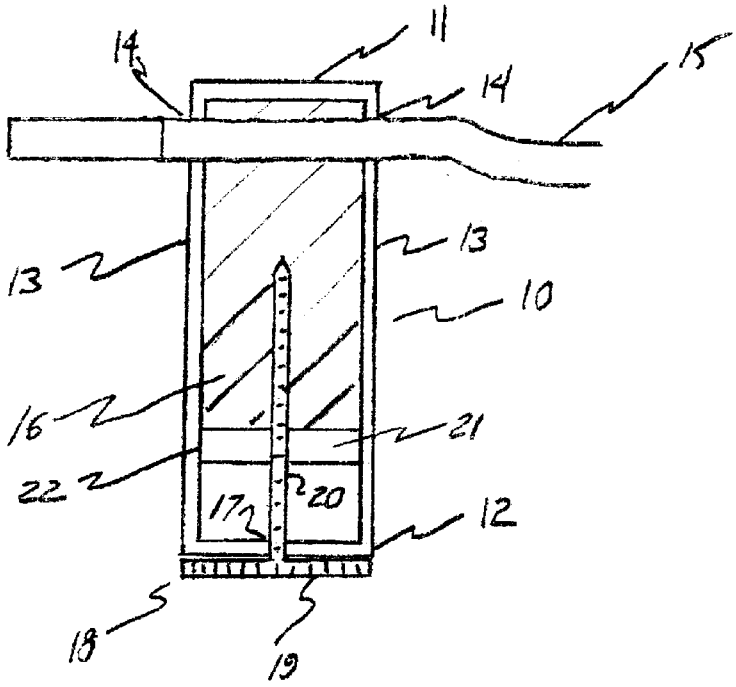
FIG. 1 is a simplified cross-sectional diagram in the longitudinal direction of an applicator in accordance with the present invention.

The particular ties which can be treated in accordance with the present invention are not critical. The ties can be, for example, shoe-laces, ties of aprons, sweatshirt hoods or other clothing cords. The materials of construction of the ties are also not critical to the present invention. The details of such materials of construction are known to those skilled in the art. The invention is hereafter described with respect to shoelaces, although other ties, e.g., the ties described above, are intended to be included within the claims which follow.

The solid waxy compositions of the present invention can be comprised of one or more synthetic or naturally occurring waxy ingredients, and may be organic or inorganic in nature. As used herein, the term "waxy ingredient" means an ingredient that possesses characteristics similar to wax or petrolatum as commonly known, e.g., solid or semi-solid at room temperature, smooth in texture and preferably a malleable solid at −20 to 50° C. See, for example, Hawleys Condensed Chemical Dictionary, 11$^{th}$ edition, Van Nostrand Reinhold, New York, 1987.

Classes of waxes include, for example, animal waxes, plant waxes, mineral waxes, silicone waxes, synthetic waxes and petroleum waxes. Suitable waxes include, for example, bayberry, beeswax, candelilla, carnauba, ceresin, cetyl esters, hydrogenated jojoba oil, hydrogenated jojoba wax, hydrogenated microcrystalline wax, hydrogenated rice bran wax, japan wax, jojoba butter, jojoba esters, jojoba wax, lanolin wax, microcrystalline wax, mink wax, montan acid wax, montan wax, ouricury wax, ozokerite, paraffin, PEG-6 beeswax, PEG-8 beeswax, rice bran wax, shellac wax, spent grain wax, sulfurized jojoba oil, synthetic beeswax, synthetic candelilla wax, synthetic carnauba wax, synthetic japan wax, synthetic jojoba oil, synthetic wax, stearoxy dimethicone, dimethicone behenate, stearyl dimethicone, and the like, as well synthetic homo- and copolymer waxes from the ethylene series. For use in the present invention, a waxy ingredient will have a melting point of 30 to 135° C., preferably 50 to 105° C. While waxy ingredients having a melting point above 135° C. may be used in the waxy compositions of the present invention, they would typically be blended with lower melting waxes so that the melting point of the waxy composition is in the range of 30 to 135° C.

The waxes may also be fluorinated waxes, either alone or in addition to the above-mentioned natural or synthetic waxes, such as fluorinated dimethicone copolyols disclosed in U.S. Pat. No. 5,446,114. An example of such a fluorinated wax is dimethiconol fluoroalcohol dilinoleic acid, which is sold by Siltech, Inc., under the tradename Silwax F. Preferred waxes are ethylene homopolymers or ethylene copolymers. The molecular weight of the ethylene homopolymer and/or copolymers used as the wax component may vary, so long as the melting point of the homo- or copolymer either alone or in combination is preferably not greater than 135° C. Generally, polyethylene waxes having a melting point range of 30 to 135° C. will have a weight average molecular weight ranging from about 100 and 2,000 grams per gram mole. Preferably, the ethylene copolymers are comprised of ethylene monomer units in either repetitive or random sequence, in combination with other monomer units Examples of ethylene homo- and copolymers which may be used in the invention are set forth in U.S. Pat. No. 5,556,613.

The waxy compositions of the present invention may also advantageously contain a natural or synthetic tackifier. Such tackifiers are typically resinous substances and are well recognized in the art. Examples include rosin and rosin derivatives, polymerized terpenes, terpene phenolics and other phenolic resins, cuanaroneidene resins, petroleum hydrocarbon resins and the like. Any amount of tackifier may be added to the waxy compositions of the present invention. Particularly good results have been obtained when the waxy compositions of the present invention contain tackifier in an amount of from about 5% to about 30% by weight, based on the total weight of the waxy ingredient and tackifier. Particularly good results were obtained with a composition containing 20% tackifier.

The composition may also comprise other ingredients to adjust the properties of the waxy composition or affect its characteristics. In general, it is preferred that the waxy composition have a sufficient combination of properties, e.g., viscosity and molecular weight, to resist flowing out of the applicator when not in use, yet flow around and coat the shoelace when in use. The waxy compositions should remain at an appropriate consistency for application to a tie in a wide range of outdoor temperatures, for example from 20 to 100° F. When properly formulated, the waxy compositions of the present invention will not flake off when applied to a tie. The amount of the waxy material in the composition is typically from 0.1 to 100%, based on the total weight of the composition.

Typical functions of other ingredients include for example, diluents, preservatives, pigments, fillers and functional or decorative additives such as reflective particles. Such other ingredients when used may present in an amount of from about 0 to 99.9 wt % based on the total weight of the waxy composition but typically comprise less than 50% of the composition. The choice of such other ingredients and the amounts used is well within the skill of the experienced formulator.

Examples of other ingredients include oils, e.g., volatile oils and nonvolatile oils. With respect to the volatile oils, the term "volatile" means that the oil or solvent has a vapor pressure of at least 2 mm. of mercury at 20° C. The viscosity of the volatile solvent is preferably 0.5 to 5 centipoise at 25° C. Such volatile solvents include volatile low viscosity silicone fluids such as cyclic silicones. Volatile linear polydimethylsiloxanes are also suitable. These silicones are available from various sources including Dow Corning Corporation and General Electric. Dow Corning silicones are sold under the tradenames Dow Corning 244, 245, 344, 345, and 200 fluids. These fluids comprise octamethylcyclotetrasiloxane, decamethylcyclopentasiloxane, hexamethyldisiloxane, or mixtures thereof.

Also suitable as the volatile solvent component are straight or branched chain paraffinic hydrocarbons having 5–20 carbon atoms, more preferably 10–16 carbon atoms. Suitable hydrocarbons are pentane, hexane, heptane, decane, dodecane, tetradecane, tridecane, and $C_{8-20}$ isoparaffins as disclosed in U.S. Pat. Nos. 3,439,088 and 3,818,105. Preferred volatile paraffinic hydrocarbons have a molecular weight of 70 to 190, more preferably 160–180, and a boiling point range of 30 to 320° C., preferably 60 to 260° C., and a viscosity of less than 20 centipoise at 25° C. Such paraffinic hydrocarbons are available from EXXON under the ISOPAR trademark as ISOPAR A, B, C, D, E, G, H, K, L, and M. Similar paraffinic hydrocarbons are also available from Shell Oil under the Shellsol trademark, in particular Shellsol 71; and from Phillips Petroleum under the tradename Soltrol 100, 130, and 220. In addition these paraffinic hydrocarbons may be purchased from Permethyl Corporation under the tradename Permethyl 99A or Permethyl R.

With respect to the nonvolatile oil, the term "nonvolatile" means that the oil has a vapor pressure of less than about 2 mm. of mercury at 20° C. The nonvolatile oil generally has a viscosity of greater than 10 centipoise at 25° C., and may range in viscosity up to 1,000,000 centipoise at 25° C., preferably 100 to 600,000 centipoise at 25° C. Preferably the oil is a liquid to semi-solid at room temperature. Particularly preferred as the nonvolatile oil component is a $C_{12-22}$ fatty ester of citric acid. Preferably the fatty ester of citric acid is formed by the reaction of a $C_{12-22}$ fatty alcohol with citric acid. One, two, or three carboxylic acid groups of the citric acid may be esterified.

Other nonvolatile oils that may be used include esters known in the art such as isotridecyl isononanoate, PEG-4 diheptanoate, isostearyl neopentanoate, tridecyl neopentanoate, cetyl octanoate, cetyl palmitate, cetyl ricinoleate, cetyl stearate, cetyl myristate, coco-dicaprylate/caprate, decyl isostearate, isodecyl oleate, isodecyl neopentanoate, isohexyl neopentanoate, octyl palmitate, dioctyl malate, tridecyl octanoate, myristyl myristate, octododecanol, and fatty alcohols such as oleyl alcohol, isocetyl alcohol, and the like.

The oil may also comprise naturally occuring glyceryl esters of fatty acids, or triglycerides. Both vegetable and animal sources may be used. Examples of such oils include castor oil, lanolin oil, triisocetyl citrate, $C_{10-18}$ triglycerides, caprylic/capric/triglycerides, coconut oil, corn oil, cottonseed oil, linseed oil, mink oil, olive oil, palm oil, illipe butter, rapeseed oil, soybean oil, sunflower seed oil, walnut oil, and the like.

Also suitable as the oil are synthetic or semi-synthetic glyceryl esters, e.g. fatty acid mono-, di-, and triglycerides which are natural fats or oils that have been modified, for example, acetylated castor oil, glyceryl stearate, glyceryl dioleate, glyceryl distearate, glyceryl trioctanoate, glyceryl distearate, glyceryl linoleate, glyceryl myristate, glyceryl isostearate, PEG castor oils, PEG glyceryl oleates, PEG glyceryl stearates, PEG glyceryl tallowates, and so on.

Also suitable as the oil are nonvolatile hydrocarbons such as isoparaffins, hydrogenated polyisobutene, mineral oil, squalene, petrolatum, and so on.

Straight or branched chain fatty alcohols known in the art such as, for example, cetyl alcohol, stearyl alcohol, cetearyl alcohol, and the like may be used.

Also suitable as the oil are various lanolin derivatives such as acetylated lanolin, acetylated lanolin alcohol, and so on.

Also suitable as the nonvolatile oil are various fluorinated oils such as fluorinated silicones, fluorinated esters, or perfluropolyethers. Particularly suitable are fluorosilicones such as trimethylsilyl endcapped fluorosilicone oil, polytrifluoropropylmethylsiloxanes, and similar silicones such as those disclosed in U.S. Pat. No. 5,118,496.

Guerbet esters are also suitable oils. The term "guerbet ester" means an ester which is formed by the reaction of a guerbet alcohol with a carboxylic acid, the details of which are known to those skilled in the art. Examples of suitable fluoro guerbet esters are set forth in U.S. Pat. No. 5,488,121. Suitable fluoro-guerbet esters are also set forth in U.S. Pat. No. 5,312,968. Most preferred is a guerbet ester having the tentative CTFA name fluoro-octyldodecyl meadowfoamate. This ester is sold by Siltech, Norcross Ga. as Developmental Ester L61125A, under the tradename Silube GME-F.

ChapStick™ lip balm, which contains 44% petrolatums, 1.5% Padimate 0, 1% lanolin, 1% isopropyl myristate and 0.5% cetyl alcohol, sold by the A. H. Robins Co., Richmond, Va., has been found to exhibit the desirable properties of the waxy compositions of the present invention.

The manner in which the waxy composition is applied to a tie is not critical to the method of the present invention. Application of the waxy composition can be done by hand, e.g., with the fingers, a squeeze tube, or an applicator such as described herein. In accordance with the present invention, it is not necessary to apply the waxy composition to the entire shoelace. Quite advantageously, the composition can be applied to only a portion of the shoelace, e.g., that portion of each end used in forming a knot.

The present invention is hereinafter described with reference to the drawings. This description is illustrative of the invention and is not intended to limit the scope of the claims. Those skilled in the art will recognize that description does not include details of features, e.g., materials of construction, mechanical elements such as stops, functional protrusions, recesses, caps, manufacturing and assembly information, etc., known to those skilled in the art of applicator design and manufacture.

Referring to FIG. 1, an applicator is shown with a body 10 in the form of a tubular cylinder, i.e., circular cross-section. Alternatively, the body may have a square, rectangular or oval cross-section, for example. The body comprises a closed top end 11 and a closed bottom end 12. The reference to "top end" and "bottom end" is for convenience of discussion. The applicator has no preferential vertical orientation with respect to top or bottom. The body 10 has a side wall 13 disposed longitudinally between top end 11 and botton end 12. Sidewall 13 has an opening 14 of sufficient size through which a shoe lace 15 may be passed to be in contact with a composition 16 (such as described above).

Lower end 12 has an opening 17 there through, a rotatable dispensing screw 18 including a control member 19 disposed adjacent the lower end 12 and a threaded shaft 20, said threaded shaft extending through the opening 17 in the lower end 12 longitudinally into the body 10, the threaded shaft being threadably engaged with a threaded movable support 21 inside the body 10, said support being in contact with an inner surface 22 of the body 10 so as to prevent rotation of the support 21 in the body 10.

Figure 2:
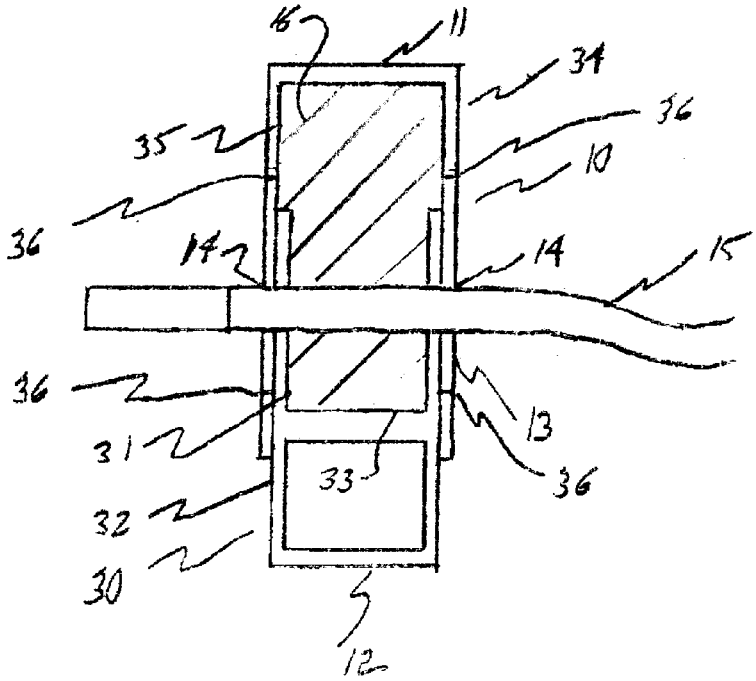
FIG. 2 is a simplified cross-sectional diagram in the longitudinal direction of an applicator in accordance with the present invention.
Figure 3:
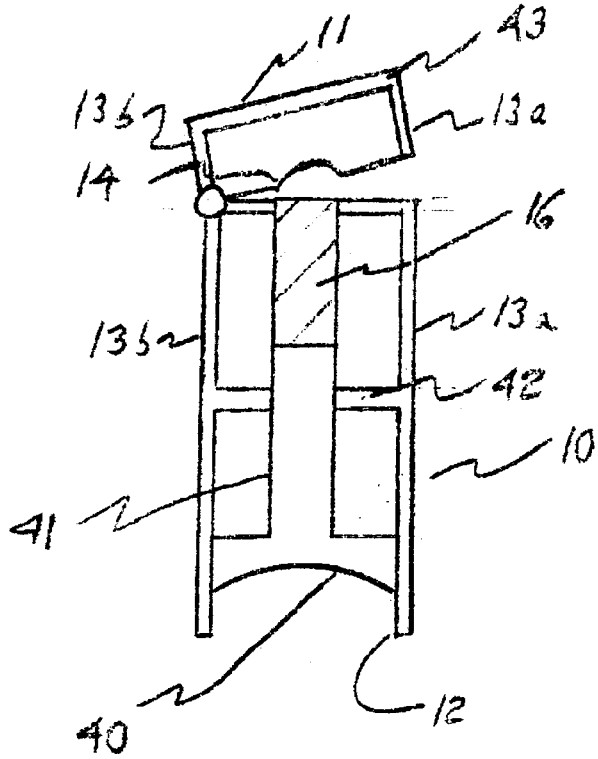
FIG. 3 is a simplified cross-sectional diagram in the longitudinal direction of an applicator in accordance with the present invention.
Figure 4:
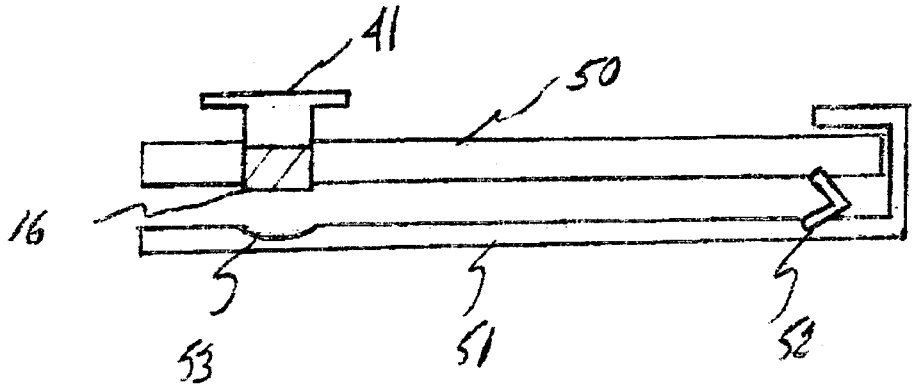
FIG. 4 is a simplified cross-sectional diagram of an applicator in accordance with the present invention.

Referring to FIGS. 2, 3 and 4, the numbered elements are the same as describe with reference to FIG. 1 except as otherwise stated.

In FIG. 2, an applicator is shown wherein the body 10 comprises an inner shell 30 having an inner surface 31 and an outer surface 32 and a fixed support 33 in contact with the inner surface 31 of the inner shell so as to prevent movement of the support 33, an outer shell 34 having an inner surface 35 which fits concentrically around the perimeter of outer surface 32 of the inner shell 30 to permit sliding movement in the longitudinal direction between the inner shell 30 and the outer shell 34. Outer shell 34 has a slot whose ends are shown by lines 36 to permit movement over shoe lace 15. Outer shell 34 may rotate or lift to close opening 14 when not in use. Incremental rotation means are known in the art. See, for example, U.S. Pat. No. 6,129,471, issued Oct. 10, 2000.

In FIG. 3, the lower end comprises a finger accommodating opening 40 which can retain a finger of a user within the lower end 12 of the body 10 such that the finger of the user fits within the body 10. Body 10 has two sidewalls 13*a* and 13*b* disposed in a parallel orientation to each other. By pushing finger accommodating opening 40, a user can move plunger 41 through plunger guide 42 and move composition 16 upward. The body also comprises a hinged cap 43 which can pivot between a closed position and an open position. In this aspect of the invention, the opening 14 is in a portion of the side wall 13 that comprises cap 43.

In FIG. 4, a first arm 50 is pivotally connected to a second arm 51 and separated by spring element 52. Second arm 51 has a recessed portion 53 to guide a shoelace during the application of composition 16 by depressing plunger 41.

The invention is hereinafter described by the following examples which are not intended to limit the scope of the claims which follow. All percentages are by weight unless otherwise specified.

EXAMPLES

Example 1

To test the concept of treating the surface of a shoelace in order to reduce incidences of spontaneous untying of knots in such laces, a commercially available lip balm product "Chapstick", as referenced above, was applied to each end of a shoelace in an athletic shoe prior to tying a knot. As a control, the lace of the left shoe was left untreated, with the Chapstick product applied only to the lace on the right shoe. The Chapsick product was applied by running the Chapstick formulation up and down the portion of the lace extending from the shoe eyelets. Effort was made to cover all sides of the lace by traversing the lace at varying angles to assure complete coverage. The effectiveness of this treatment was evaluated by wearing the running shoes for a total of ten running trials over a period of two weeks. Conscious effort was made to tie each shoelace (treated and untreated) in the same manner with the same tension. Over the two week period, the untreated shoe lace spontaneously untied three times, while the treated lace had no incidences of spontaneous untying.

Example 2

To improve the application of tack enhancing substance on laces a US military issue lip balm product was modified. The US military lip balm product is packaged similarly to the commercial Chapstick product, in a cylindrical container with screw advancement of the active lip balm substance. In use, the cap is removed and the lip balm is advanced to be exposed at the top of the cylinder. To modify this packaging to improve it's application of tack enhancing substance to laces, a 3/16 inch hole was drilled though the side of the cap approximately centered on the vertical dimension. A second 3/16 inch hole was made directly opposed to the first hole on the cap, allowing for a lace to be threaded in one hole and be pulled through the second hole. The cap was replaced and secured to the base of the lip balm applicator with tape.

Treatment of a shoelace was attempted by passing a shoelace fully through both holes in the secured cap and advancing the lip balm substance while traversing the lace with the modified applicator. It was observed that the waxy lip balm product was too viscous to fully surround the lace for effective application. The cap was removed and the lip balm substance was removed from the applicator. The lip balm substance was heated in a microwave oven for approximately one minute to slightly soften the product. Commercial lip balm substance Chapstick was removed from its applicator and mixed with the softened military issue lip balm at a ration of approximately 3 to 1 (military/commercial). The mixing was accomplished by manually kneading the two products together until homogenous. This mixture was then reinserted into the modified applicator and the cap was replaced and secured with tape.

A lace was reinserted through both holes in the cap and the modified lip balm substance advanced by rotating the knob at the base of the applicator until the cap was filled with modified lip balm. With the modified applicator it only took one traverse of the lace to coat the lace on all sides. It was observed that viscosity of the waxy composition should be low enough to allow the full encompassing of the lace and thus allow the one stroke application, yet not so low as to cause oozing of the tack enhancing substance though the holes in the cap.

To demonstrate the effectiveness of the modified tack enhancing substance with the one stroke application by the modified applicator, two identical shoelaces were thread through a pair of holes in poster board spaced approximately three inches apart. The laces were side-by-side on the poster board and the laces on the right side were treated by placing each lace end though the modified applicator and advancing the tack enhancing substance by rotating the base of the applicator. One transverse of each lace end was found sufficient to effect treatment. The lace on the left was left untreated as a control. A standard shoelace knot was tied on each lace with conscious effort to apply equal force when tying each knot. Effectiveness of the treatment was ascertained by pulling one lace end to untie the knot and noting the force required. It was observed that the untreated knot required significantly less effort to untie, while the treated knot resisted untying to the extent that the posterboard bent with the untying force. Two other individuals performed this tying and untying test and reported that the treated laces required more force to untie relative to the untreated control.

Example 3

The following four waxy compositions were prepared using different proportions of Mobil Wax 130 and Snow White Petrolatum supplied by Polygon Corp.:

Comp. A—50% Mobil Wax 130 and 50% Petrolatum

Comp. B—60% Mobil Wax 130 and 40% Petrolatum

Comp. C—70% Mobil Wax 130 and 30% Petrolatum

Comp. D—80% Mobil Wax 130 and 20% Petrolatum

The compositions were prepared by heating the wax and petrolatum products together in a double boiler while stirring constantly until thoroughly mixed. The composition was then cooled to room temperature and evaluated for use in the method of the present invention by testing in the applicator described in Eample 2. Comp. A was judged to be to soft to function properly in the applicator. Comp. B and C were judged to have good consistency for use in the present invention but were subject to flaking when applied to a tie. Comp. D was judged to be too hard to be useful in the present invention.

Example 4

A waxy composition was prepared by combining 60% Mobil Wax 130, 30% Petrolatum and 10% Komotac 282S (a modified gum rosin ester tackifier supplied by Momentum technologies, Inc.) and heating the mixture in a double boiler while stirring for approximately 30 minutes until the Komotac was completely dissolved and the products thoroughly mixed. The waxy composition was allowed to cool to room temperature and then was evaluated for use in the present invention. The composition was placed in an applicator similar to that described in Example 2 and applied to shoe laces. The composition was judged to have excellent consistency and spread well onto the shoelaces. No flaking or breakage was observed with respect to the laces coated with the composition.

Example 5

Example 4 was repeated using Eastotac H-100W (a C5 aliphatic hydrocarbon tackifier resin supplied by Eastman Chemical) The composition was judged to have excellent consistency and physical properties for use in the present invention. No flaking or breakage was observed when the composition was applied to shoelaces.

Example 6

A waxy composition was prepared following the procedures of Example 4 using 55% Mobil Wax 130, 25% Snow White Petrolatum and 20% Easotac Resin H-100W. After being cooled to room temperature, the composition was evaluated for use in the present invention. The composition was found to have excellent physical properties and no flaking or breaking was observed when it was applied to laces. Knots formed with shoelaces coated with this composition showed superior resistance to loosening or untying.

Those skilled in the art will recognize that the various elements described in the drawings, e.g., dispensing screw, finger accommodating opening, hinged cap, can be interchanged to suit a particular design. Also, those skilled in the art will recognize that other elements and variations not specifically described, e.g., use of a spring to move the composition to the opening, are within the scope of the claimed invention.

We claim:

1. A method for inhibiting a knotted tie from loosening, comprising applying to that portion of the ends of the tie used to form a knot a waxy composition containing a (waxy ingredient) wax component and a tackifier component, said tackifier component being presenting an amount of about 5 to 30 percent by weight based on the combined total weight of the wax component and the tackifier component, prior to knotting the tie.

2. The method of claim 1 wherein the waxy composition contains a (waxy ingredient) wax component which is naturally occurring.

3. The method of claim 1 wherein the (waxy ingredient) wax component is synthetic.

4. The method of claim 1 wherein the tie is a shoelace and said waxy composition is applied to the ends of the shoelace extending beyond the eyelets of a shoe.

5. The method of claim 1 wherein the waxy composition is a solid at a temperature of from about −20 to 50° C.

* * * * *